US007244199B1

(12) United States Patent
Romano

(10) Patent No.: US 7,244,199 B1
(45) Date of Patent: Jul. 17, 2007

(54) PORTABLE STREET HOCKEY BACKSTOP

(76) Inventor: Robert Romano, 30 Cotton La., Levittown, NY (US) 11756

( * ) Notice: Subject to any disclaimer, the term of this patent is extended or adjusted under 35 U.S.C. 154(b) by 0 days.

(21) Appl. No.: 11/232,156

(22) Filed: Sep. 21, 2005

(51) Int. Cl.
*A63B 63/00* (2006.01)

(52) U.S. Cl. ..... 473/478; 273/127 R; 273/400; 473/446

(58) Field of Classification Search ..... 273/398–402; 473/473, 474, 476, 478, 421, 197, 446
See application file for complete search history.

(56) References Cited

U.S. PATENT DOCUMENTS

| | | | | | |
|---|---|---|---|---|---|
| 2,819,901 | A | | 1/1958 | Mateja | |
| 2,986,398 | A | * | 5/1961 | Oliver | 473/173 |
| 3,013,801 | A | * | 12/1961 | Kirkconnell, Jr. | 473/197 |
| 3,475,025 | A | * | 10/1969 | Uphaus | 473/421 |
| 3,840,228 | A | | 10/1974 | Greaney | |
| 4,290,602 | A | | 9/1981 | Kennedy | |
| 4,420,158 | A | * | 12/1983 | Klock et al. | 473/478 |
| 4,880,239 | A | | 11/1989 | Leneveu | |
| 5,054,791 | A | * | 10/1991 | Ball | 273/396 |
| 5,273,292 | A | * | 12/1993 | Pardi et al. | 273/400 |
| 5,277,430 | A | | 1/1994 | Naccarato | |
| 5,407,211 | A | * | 4/1995 | Bottiglieri | 273/400 |
| 5,564,711 | A | | 10/1996 | Scheie | |
| 5,586,768 | A | * | 12/1996 | Pavonetti | 473/478 |
| 6,189,889 | B1 | | 2/2001 | Yip | |
| 6,485,373 | B1 | | 11/2002 | Stephens | |
| 6,849,009 | B1 | | 2/2005 | Forlini | |
| 6,889,982 | B1 | * | 5/2005 | Gove | 273/343 |
| 2003/0166424 | A1 | * | 9/2003 | Wu | 473/476 |

FOREIGN PATENT DOCUMENTS

| | | |
|---|---|---|
| CA | 1 140 180 | 1/1983 |
| WO | WO95/24948 | 9/1995 |
| WO | WO99/06125 | 2/1999 |

* cited by examiner

*Primary Examiner*—Mark S. Graham
(74) *Attorney, Agent, or Firm*—Michael I Kroll

(57) ABSTRACT

A backstop for a street hockey goal comprising left and right stanchions with a net fastened therebetween with a strut fastenable to a hockey goal for supporting the net in a deployed position. Once deployed the net exceeds the height of the hockey goal and extends beyond said goal to the left and right. The base of each stanchion matingly engage each other when in the folded position with the net having a partial slit vertically extending with fasteners that attach to their respective stanchions when in the folded position.

10 Claims, 12 Drawing Sheets

PORTABLE STREET HOCKEY BACKSTOP

BACKGROUND OF THE INVENTION

1. Field of the Invention

The present invention relates generally to sports equipment and, more specifically, to a backstop for a street hockey goal comprising left and right stanchions with a net fastened therebetween with struts fastenable to a hockey goal for supporting the net in a deployed position. Once deployed the net exceeds the height of the hockey goal and extends beyond said goal to the left and right.

Furthermore the base of each stanchion matingly engage each other when in the folded position with the net having a partial slit vertically extending with fasteners that are attached to their respective stanchions when in the folded position and fastenable to the rear base of the hockey goal when deployed.

Additionally, the top also has matingly engaging members when in the folded position with one stanchion having a pivotal member that engages a locking member on the opposing stanchion when in the folded position.

2. Description of the Prior Art

There are other net-like devices designed as backstops. Typical of these is U.S. Pat. No. 2,819,901 issued to Mateja on Jan. 14, 1958.

Another patent was issued to Greaney on Oct. 8, 1974 as U.S. Pat. No. 3,840,228. Yet another U.S. Pat. No. 4,290,602 was issued to Kennedy on Sep. 22, 1981 and still yet another was issued on Nov. 14, 1989 to Leneveu as U.S. Pat. No. 4,880,239.

Another patent was issued to Naccarato on Jan. 11, 1994 as U.S. Pat. No. 5,277,430. Yet another U.S. Pat. No. 5,564,711 was issued to Scheie on Oct. 15, 1996. Another was issued to Yip on Feb. 20, 2001 as U.S. Pat. No. 6,189,889 and still yet another was issued on Nov. 26, 2002 to Stephens as U.S. Pat. No. 6,485,373.

Another patent was issued to Forlini on Feb. 1, 2005 as U.S. Pat. No. 6,849,009. Yet another Canadian Patent No. 1,140,180 was issued to Fisher on Jan. 25, 1983. Another was published to Paterson on Sep. 21, 1995 as International Patent Application No. WO95/24948 and still yet another was published on Feb. 11, 1999 to Jirsa as U.S. patent No. WO99/06125.

U.S. Pat. No. 2,819,901

Inventor: Joseph S. Mateja

Issued: Jan. 14, 1958

A collapsible and removable backstop comprising a pair of end posts for mounting vertically in spaced socket supports, a wire mesh screen covering the entire area between and in front of said posts, said screen having opposite edges extending around and arranged along sides of said posts which face outwardly relative to each other, fastening connections securing said opposite screen edges to said post sides, a pair of links having pivot connections securing their outer ends to the upper ends of said posts at points respectively located diametrically opposite said sides for movement from vertical positions lying along said posts to horizontal bracing positions behind and parallel to said screen, and a detachable connection securing said links at their inner ends against movement out of said horizontal bracing positions.

U.S. Pat. No. 3,840,228

Inventor: Daniel F. Greaney

Issued: Oct. 8, 1974

A device for use by children or adults in training or practicing hockey, characterized by its ability to return or deflect hockey pucks and so shaped that it represents a goalie's position in front of a standard goal which causes the players to develop habits which they can translate to actual play. The device is affixed in a forwardly disposed V-shape in front of a hockey goal whereby pucks striking the device are diverted to either side thereof. Additionally, the device has an aperture therethrough simulating the opening between the legs of a player and a pocket therein for receiving and holding a puck simulating the catching of a puck by a player.

U.S. Pat. No. 4,290,602

Inventor: Robert B. Kennedy

Issued: Sep. 22, 1981

A sports field barrier is disclosed for arresting the flight of a ball moving in one direction over a field of play and for rebounding the ball in another direction generally and usually reciprocal to the one direction and with the barrier being erected uprightly along a zigzag course adjacent the field of play. Where the sports field is a tennis court the barrier may be constructed by the steps of intertwining wire coils to form a section of wire mesh fencing, crimping the fencing section or mounting it to forms so as to form the wire coils into a zigzag shape, and mounted the fencing section to a fence frame with the coils stretched between a pair of upright stanchions.

U.S. Pat. No. 4,880,239

Inventor: Michael R. Leneveu

Issued: Nov. 14, 1989

A sport training apparatus for ball hitting games, such as golf, is provided with a frame which includes a base as well as a pair of uprights. A net is stretched across the uprights and has a pair of lower net corners which each are connected to a weight organized to ride along a rope inclined about 45 degree from horizontal and spanning between the base and one of the uprights at a higher point. Displacement of the weights measures impact of the ball into the net. Each of the weights is connected by means of a cord to a marker movable on a rod fixed on a graduated ruler to provide a measure of the distance the ball would have traveled unimpededly. A differential between movements of the marks measures direction of the ball.

U.S. Pat. No. 5,277,430

Inventor: Peter Naccarato

Issued: Jan. 11, 1994

A free hanging practice goal structure for recreational use in practicing games such as hockey in front of a domestic garage having a door opening, and comprising, generally a three sided rectangular frame comprising side members and a cross member, meeting at corners, flexible panels secured to the side members, and the top member, and the panels being secured to a large back panel which is adapted to be secured to structure around the garage door opening, and to at least substantially close it, junctions joining the flexible panels to the back panel, so that lower ends of the flexible panels are located adjacent the grade level adjacent the garage door, and, fastenings for fastening the back panel to structure around the garage door opening.

U.S. Pat. No. 5,564,711

Inventor: Carl E. Scheie

Issued: Oct. 15, 1996

A multipurpose sports goal assembly can be used for a variety of sports including football and soccer. The goal assembly includes a lower goal portion and a pair of telescoping upright poles. The poles are retracted when the goal is used in soccer, and the poles are extended when the goal is used in football. A net is attached to the lower goal assembly and is adapted to be releasably attached to the upright poles when the poles are extended. The structural members which form the goal assembly are removably connected so that the goal assembly can be disassembled and stored in a compact package.

U.S. Pat. No. 6,189,889

Inventor: Sam Yip

Issued: Feb. 20, 2001

A portable backstop device for enabling an individual to practice throwing and pitching baseballs without a catcher. The backstop device includes a front panel and a back panel which are attached to each other to form a backstop member. A portion of the back panel extends beyond a bottom edge of the front panel, so that the portion can be folded such that a bottom edge of the portion of the back panel can be detachably connected to the bottom edge of the front panel to define a pocket for collecting thrown and pitched baseballs. A rectangular shaped aperture formed in the front panel of the portable backstop member enables an individual to practice throwing balls and strikes without an umpire. Balls entering the aperture are collected in the pocket thus, saving time and energy spent in retrieving the thrown baseballs and also substantially prevents the baseballs from getting scuffed from hitting backfences and the like. Additionally, a ball hitting any portion of the front panel will also fall into the pocket without rebounding dangerously.

U.S. Pat. No. 6,485,373

Inventor: Roger A. Stephens

Issued: Nov. 26, 2002

A multiple sport practice apparatus which permits a person to engage in the repetitive striking of such objects at any position, even in a relatively confined location, so as to tone the required muscles, develop muscle memory of the proper motion, and develop the proper execution of the striking motion. The multiple sports practice apparatus includes, a secondary safety net section used as a back up for stray balls, and a impact net section used as the primary target so that projectile that has impinged upon falls to the base of apparatus. The apparatus is arranged to stop the flight of a ball that is incident thereon, and is suspended in Four Corners, to a structure such as rafters or walls in a garage or warehouse, but not limited to. The two nets making the apparatus gather as they rest on playing surface to form a seal at the bottom to catch balls directed toward apparatus. Balls are restrained and caught by the apparatus and laid to rest on playing surface. Gathered portion of nets also acts as a deterrent to ball rolling while on the playing surface.

U.S. Pat. No. 6,849,009

Inventor: Tracy Forlini

Issued: Feb. 1, 2005

By providing a fully adjustable net system which is quickly and easily mounted to any hockey goal assembly for peripherally surrounding the outer edges of the goal assembly and establishing an expanded protected area or zone, an easily used, readily deployable backstop or net system is attained which may be employed by a wide variety of sports enthusiasts, for controlling or preventing unwanted, errant shots from damaging property or people in the surrounding area. Furthermore, the net system of the present invention may be constructed in a wide variety of alternate sizes, shapes, and configurations for achieving broad based use and applicability.

Canadian Patent Number 1 140 180

Inventor: Mark A. Fisher

Issued: Jan. 25, 1983

The invention provides a back-stop for ball hockey and the like comprising a screen adapted to cover the opening of a garage doorway and having means to attach the top and sides of the screen to the doorway frame in the operative position. The screen may be easily stored by attaching means which attach the edges of the screen to points adjacent to the peripheral edge of the garage door to mount the screen on the back side of the doorway where it is out of the way.

International Patent Application Number WO95/24948

Inventor: Darren Hugh Paterson

Issued: Sep. 21, 1995

A collapsible net support is disclosed. The net support comprises first and second cross members, each comprising at least one elongate portion; first and second end frames, each comprising a first, a second and a third member; two junction pieces for connecting the first cross member to the end frames; and two further junction pieces for connecting the second cross member to the end frames; wherein the third member of each said end frame comprises at least two portions connected by a hinge which allows pivoting of the member between an extended condition for connection of the third member to the first and second members when said end frame is assembled and a folded condition when said end frame is disassembled.

International Patent Application Number
WO99/06125

Inventor: Brian Jirsa

Issued: Feb. 11, 1999

This invention is a collapsible sports goal (10) which is lightweight, readily portable, and folds and collapses for ease of transportation and storage. The goal is comprised of a first U-shaped frame (14) pivotally joined at side plates to a second U-shaped frame (26) thereby forming a net support. A flexible netting enclosure (152) is disposed on the net support. The first and second U-shaped frames are formed of first and second cross member sections which fit slidably within each other, thereby providing a means to adjust the width of the goal. The first U-shaped frame includes a pair of upper and lower side member sections which fit slidably within each other to allow for adjustment of the height of the goal. A series of spring loaded buttons and matching holes provide means to secure the cross member and side member sections in predetermined positions. Strapping members (250) are provided to attach the goal to a surface.

While these nets may be suitable for the purposes for which they were designed, they would not be as suitable for the purposes of the present invention, as hereinafter described.

SUMMARY OF THE PRESENT INVENTION

A primary object of the present invention is to provide a backstop for a street hockey goal.

Another object of the present invention is to provide a portable backstop for a street hockey goal.

Yet another object of the present invention is to provide a portable backstop for a street hockey goal having spaced apart stanchions with a net extending therebetween.

Still yet another object of the present invention is to provide a portable backstop for a street hockey goal wherein said net extends to the left and right of the hockey goal and extends to a height greater than said hockey goal.

Another object of the present invention is to provide a portable backstop for a street hockey goal further having at least one strut extending from the hockey goal that engages the hockey goal and supports the net in a raised position.

Yet another object of the present invention is to provide a portable backstop for a street hockey goal wherein the left and right stanchion bases matingly engage when in a folded position.

Still yet another object of the present invention is to provide a portable backstop for a street hockey goal wherein the left and right stanchion have a top member that also matingly engage when in a folded position.

Another object of the present invention is to provide a portable backstop for a street hockey goal wherein said net has a centrally disposed base positioned slit with fasteners for raising the net and securing the ends to their respective stanchions in a folded position.

Yet another object of the present invention is to provide a portable backstop for a street hockey goal wherein one stanchion has a pivotal rod that mates with a fastener on the opposing strut in the folded position.

Yet another object of the present invention is to provide a portable backstop for a street hockey goal having a partial slit vertically extending with fasteners that are attached to their respective stanchions when in the folded position and fastenable to the rear base of the hockey goal when deployed.

Additional objects of the present invention will appear as the description proceeds.

The present invention overcomes the shortcomings of the prior art by providing a backstop for a street hockey goal comprising left and right stanchions with a net fastened therebetween with a strut fastenable to a hockey goal for supporting the net in a deployed position. Once deployed the net exceeds the height of the hockey goal and extends beyond said goal to the left and right. The base of each stanchion matingly engage each other when in the folded position with the net having a partial slit vertically extending with fasteners that attach to their respective stanchions when in the folded position. The top also has matingly engaging members when in the folded position with one stanchion having a pivotal member that engages a locking member on the opposing stanchion when in the folded position.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
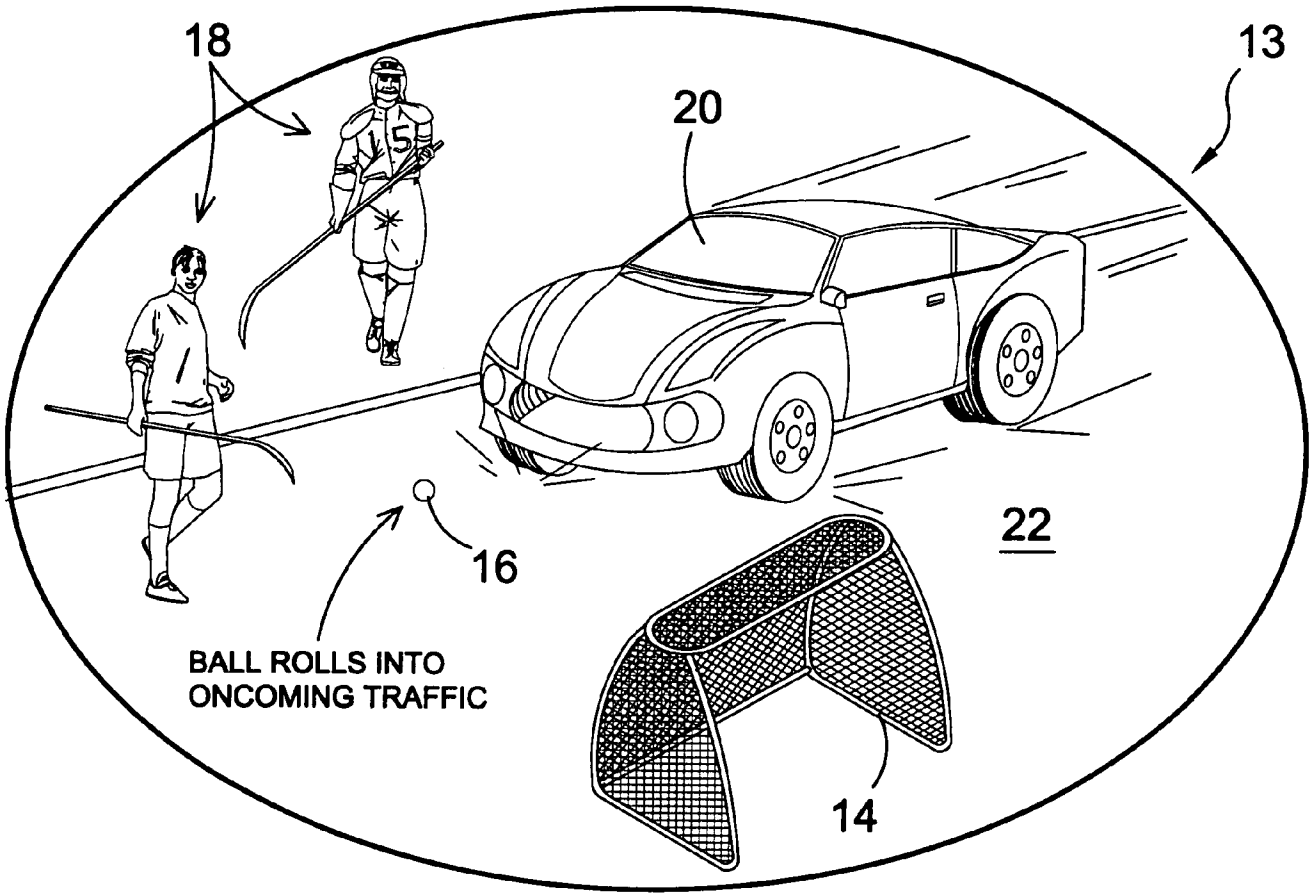
(PRIOR ART) FIG. 1
FIG. 1 is an illustrative view of prior art.

Turning now descriptively to the drawings, in which similar reference characters denote similar elements throughout the several views, the figures illustrate the Street Hockey Goal Backstop of the present invention. With regard to the reference numerals used, the following numbering is used throughout the various drawing figures.

10 Street Hockey Goal Backstop of the present invention
12 street hockey goal backstop
13 prior art
14 street hockey goal
16 ball
18 players
20 motor vehicle
22 street
24 stanchion
26 first stanchion
28 second stanchion
30 backstop net
32 base of 24
34 connectable feet
36 transverse member
38 vertical post
40 mounting post
41 pivotable net support strut
42 net support plate
44 pivotable carry rod
46 carry rod locking means
48 frame of 14
50 hinge of 41
52 slit of 30
54 hook and loop fastener element
56 hook and loop securing trap
58 retaining groove of 41
60 foldable feet
65 foldable posts
64 hinge of 62
66 hook and loop securing strap to hockey goal

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of prior art 13. Many children and adults play street hockey, a game characterized by a goal 14 and ball 16 that is played in the street 22. There are a great deal of dangers involved while playing the sport including the danger of oncoming vehicles 20. Should the ball 16 miss the goal 14 it is likely retrieved by a player 18 who must chase the ball 16 down the street 22, putting the player 18 in a dangerous situation. The present invention overcomes this problem by providing a portable backstop to further assist in arresting the flight of a wild ball 16.

Figure 2:
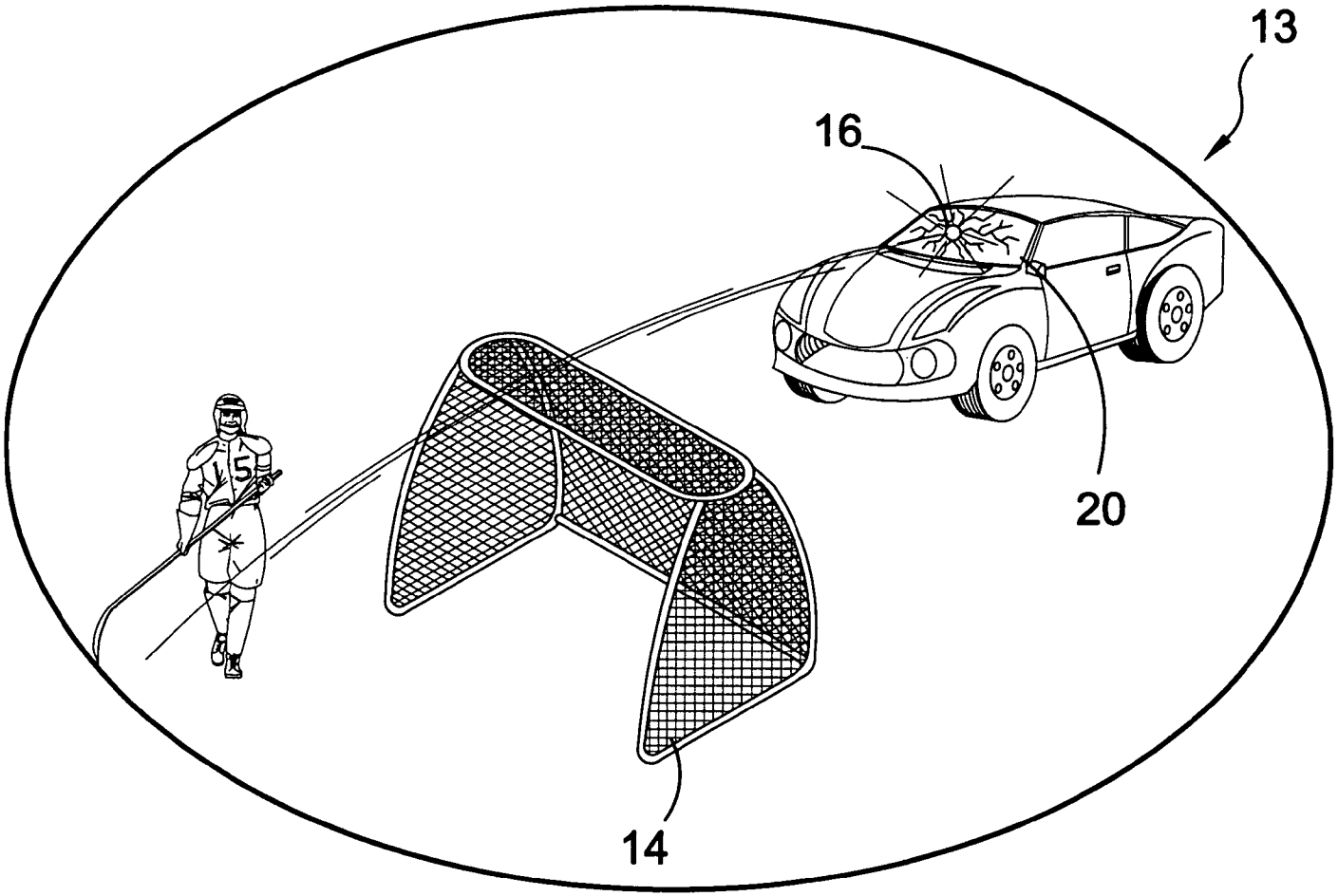
(PRIOR ART) FIG. 2
FIG. 2 is an illustrative view of prior art.

FIG. 2 is an illustrative view of prior art 13. The dangers involved while playing the sport of street hockey including the danger of hitting a parked or moving vehicle 20 with a wild shot ball 16. Should the ball 16 miss the goal 14, it is possible it could hit a vehicle 20, rendering damage to it. The present invention overcomes this problem by providing a portable backstop to further assist in arresting the flight of a wild ball.

Figure 3:
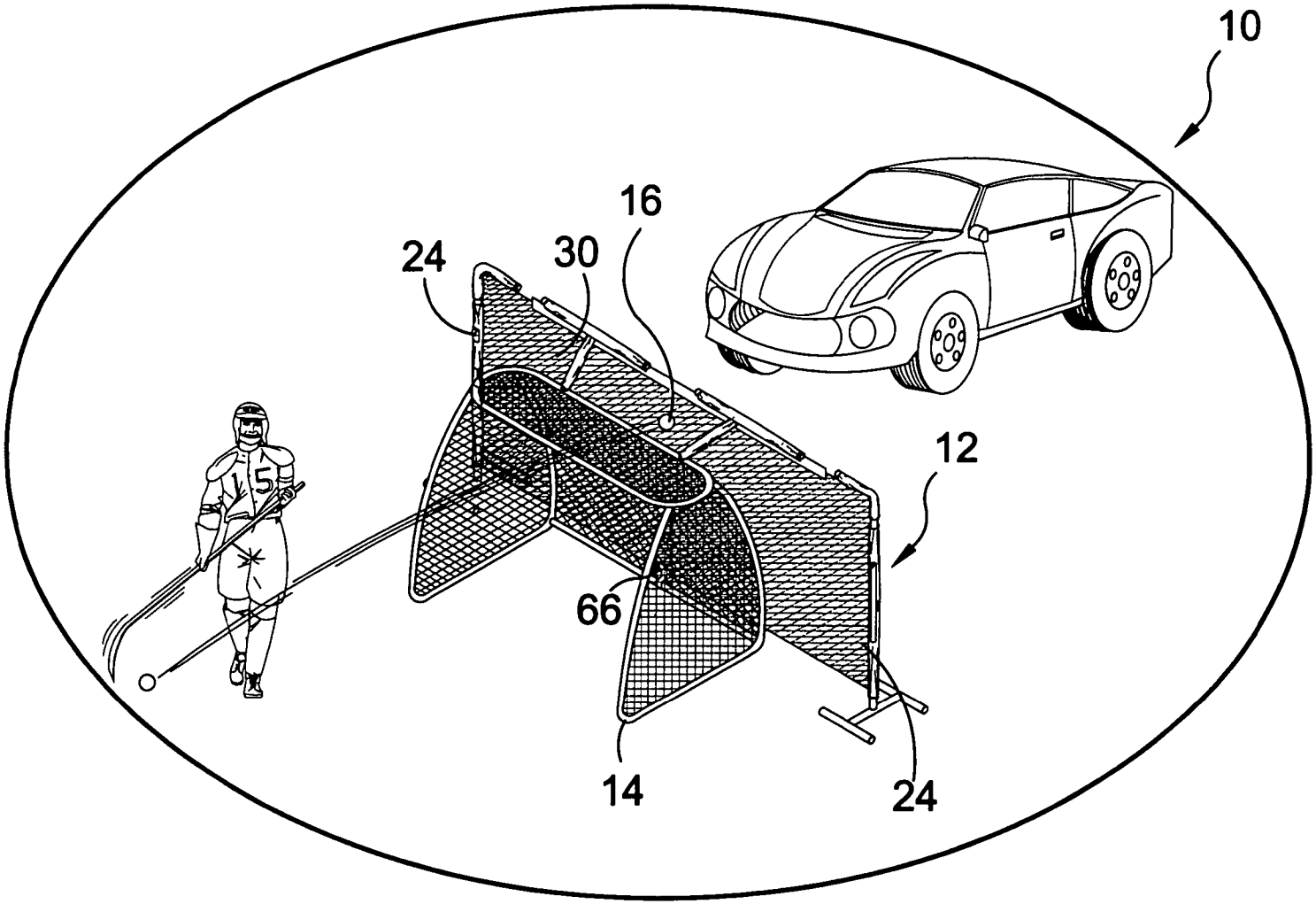
FIG. 3 is an illustrative view of the present invention in use.

FIG. 3 is an illustrative view of the present invention 10 in use. The present invention 10 a portable street hockey goal backstop 12 having spaced apart stanchions 24 with a net 30 disposed therebetween. The present invention 10 provides a backstop 12 that extends beyond the sides and above the top of a typical street hockey goal 14 that serves to stop a ball 16 (or puck) the misses the goal 14. The portable street hockey goal backstop 12 attaches to the street hockey goal by fastening hook and loop fasteners 66 around the rear base of the goal and supports the top of the net by at least one strut inserted into the net banding.

Figure 4:
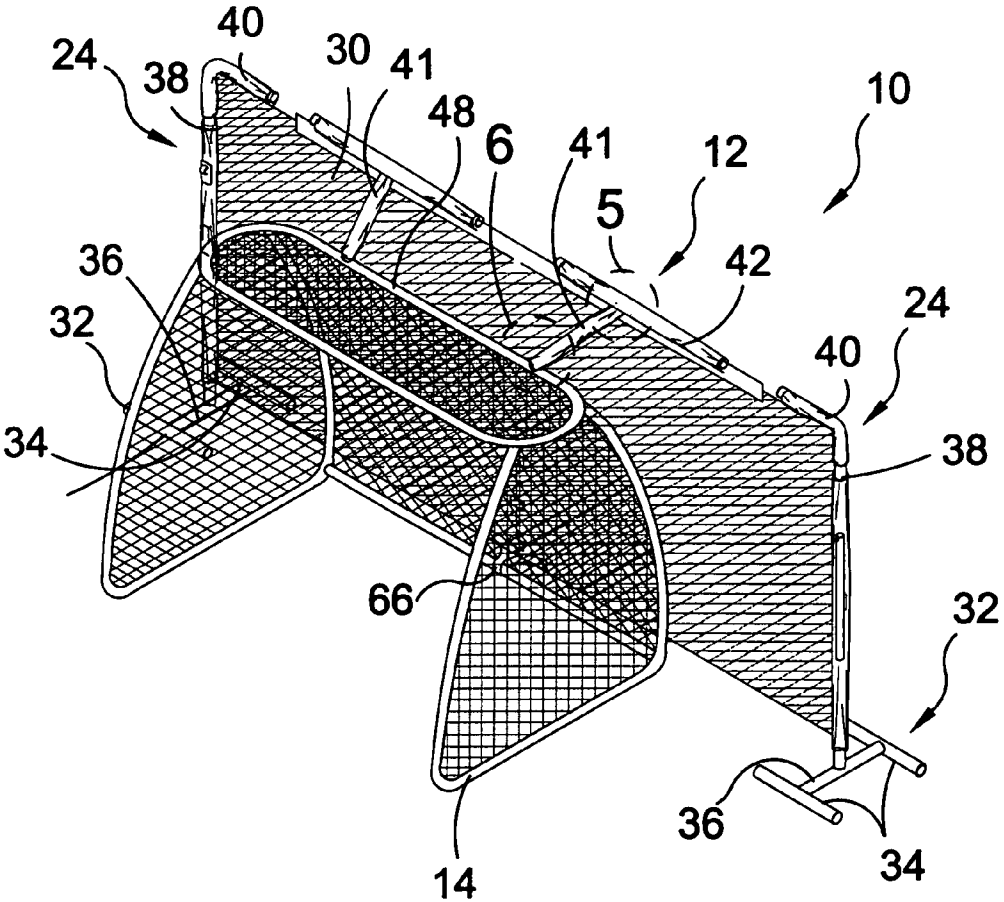
FIG. 4 is a perspective view of the present invention in use.

FIG. 4 is a perspective view of the present invention 10 in use. Shown is a perspective view of the present invention 10, a portable street hockey goal backstop 12 that is positioned behind a street hockey goal 14 to prevent a ball or puck that misses the goal from traveling beyond. The backstop 12 comprises a pair of spaced-apart opposing stanchions 24, each stanchion 24 having a base 32 with a pair of parallel feet 34 connected by a transverse member 36, a vertical post 38 extend from the transverse member 36 with a mounting post 40 disposed on the distal end thereof. A net 30 is fastened to each vertical post 38 and is supported centrally by a horizontal, elongate net support plate 42 that is secured to the mounting posts 40. The center portion of the net support plate 42 is stabilized by a pivotable net support strut 41 integral with a central rear portion of the frame 48 of the goal 14. The portable street hockey goal backstop 12 attaches to the street hockey goal by fastening hook and loop fasteners 66 around the rear base of the goal and supports the top of the net by at least one strut inserted into the net banding.

Figure 5:
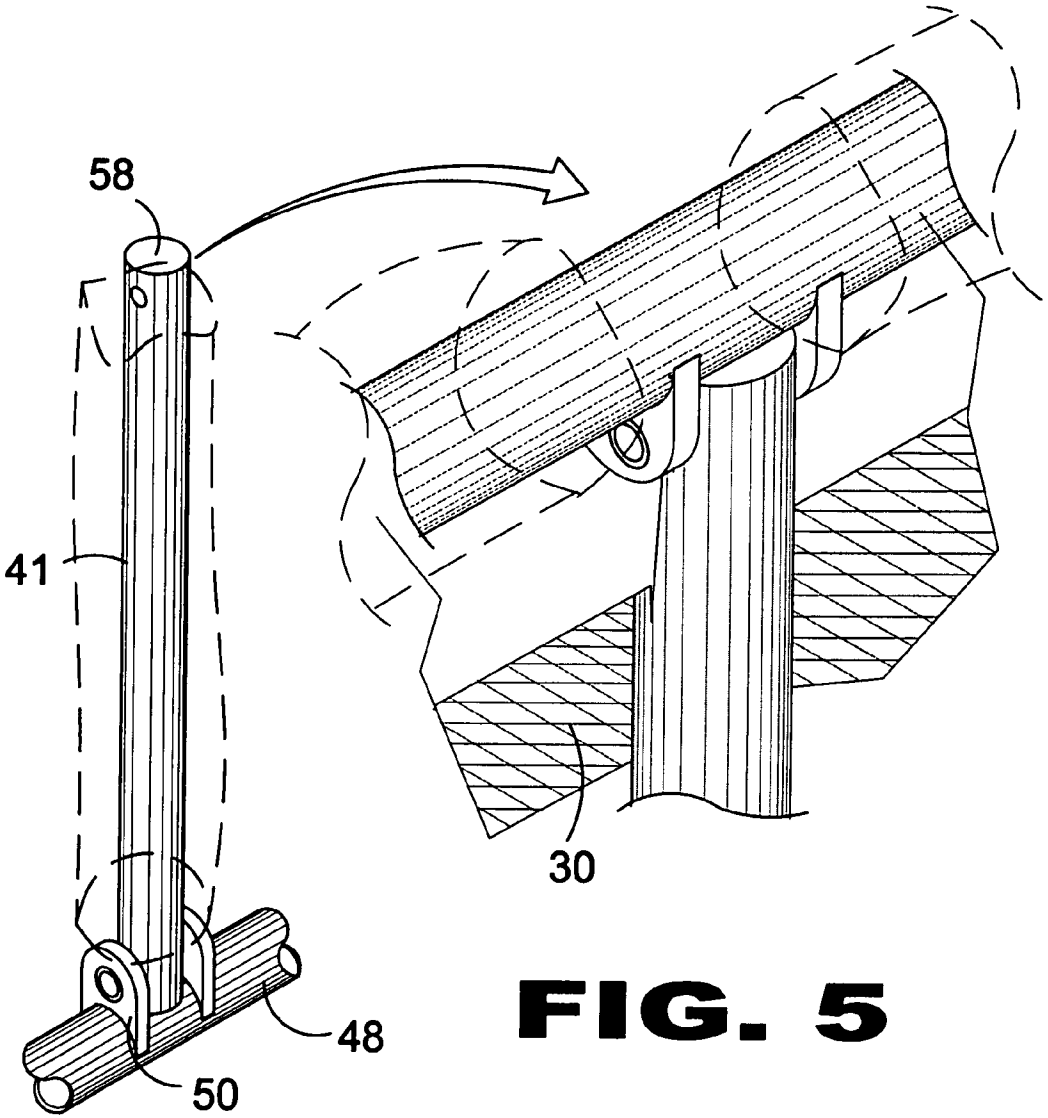
FIG. 5 is a detailed view of the present invention.

FIG. 5 is a detailed view of the pivotable net support strut 41. Shown is a detailed view of the support strut 41 taken from FIG. 4 as indicated. The support strut 41 assists in holding up the central portion of the netting 30 and is hingedly 50 attached to the back portion of the frame 48 of the hockey goal. The support strut 41 is in the vertical position and the net support plate 42 is inserted into a corresponding retaining groove 58 disposed on the distal end of the strut 41. The support strut 41 may be folded in a down position when not in use.

Figure 6:
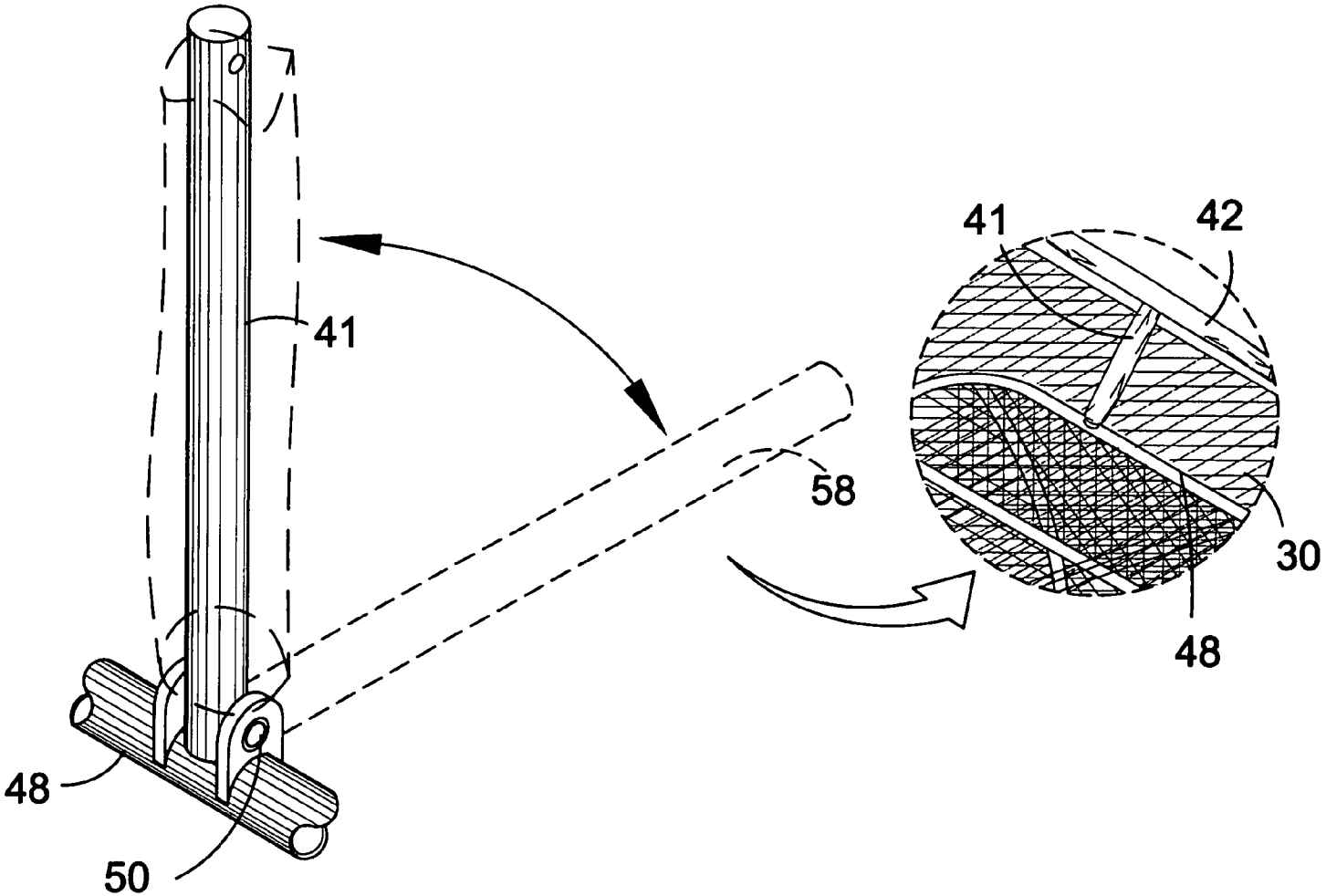
FIG. 6 is a detailed view of the present invention.

FIG. 6 is a detailed view of the pivotable net support strut 41. Shown is a detailed view of the support strut 41 taken from FIG. 4 as indicated. The support strut 41 assists in holding up the central portion of the netting 30 and is hingedly 50 attached to the back portion of the frame 48 of the hockey goal. The support strut 41 is in the vertical position and the net support plate 42 is inserted into a corresponding retaining groove 58 disposed on the distal end of the strut 41. The support strut 41 may be folded in a down position when not in use.

Figure 7:
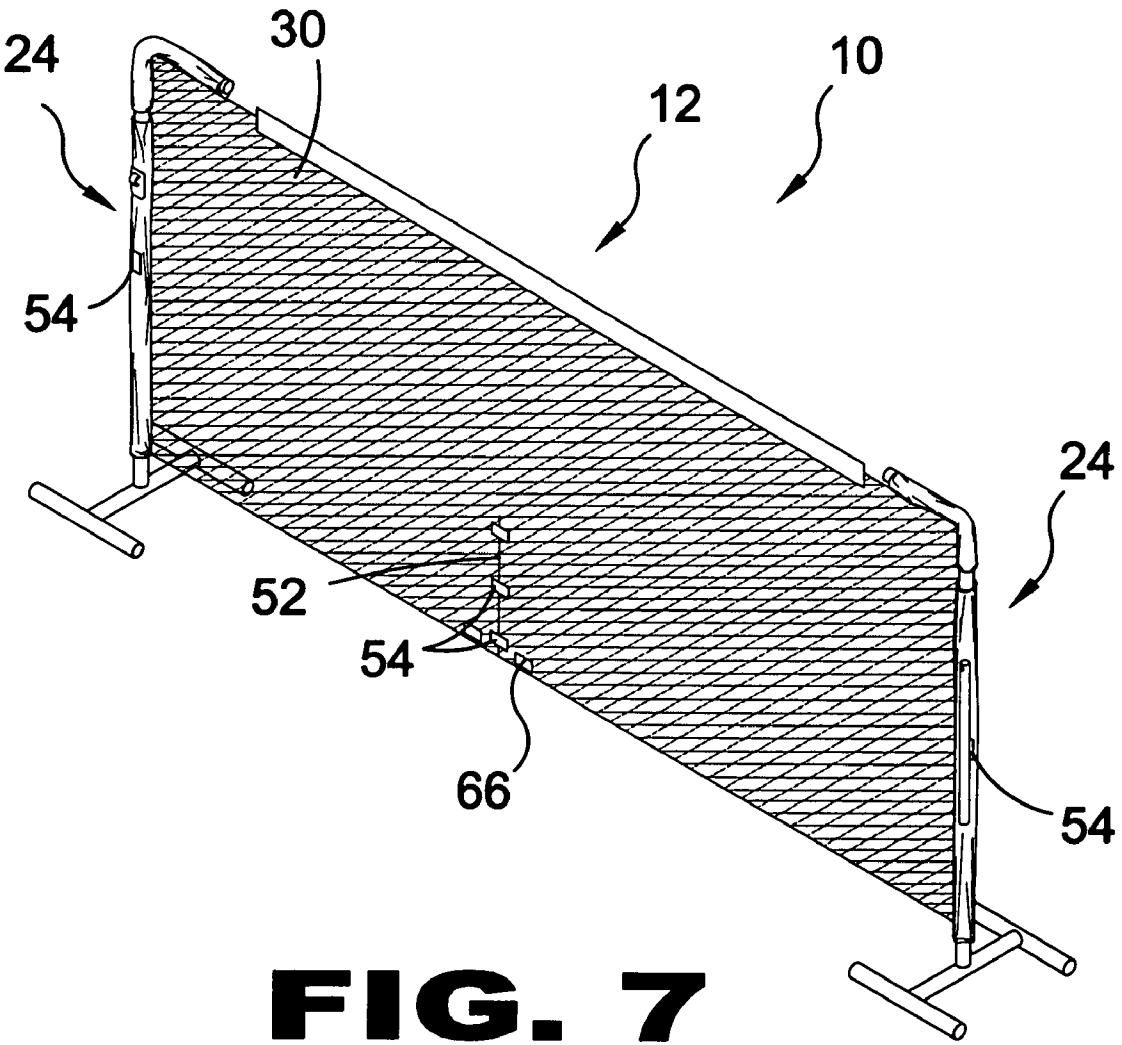
FIG. 7 is a perspective view of the present invention in an open position.

FIG. 7 is a perspective view of the present invention 10 in an open position. Shown is a perspective view of the present invention 10, a portable backstop 12 having spaced apart stanchions 24 with a net 30 disposed therebetween. The slit 52 in the net 30 is sealed with a plurality of mating hook and loop fastening elements 54 with fasteners 66 provided for securing the net to the hockey goal.

Figure 8:
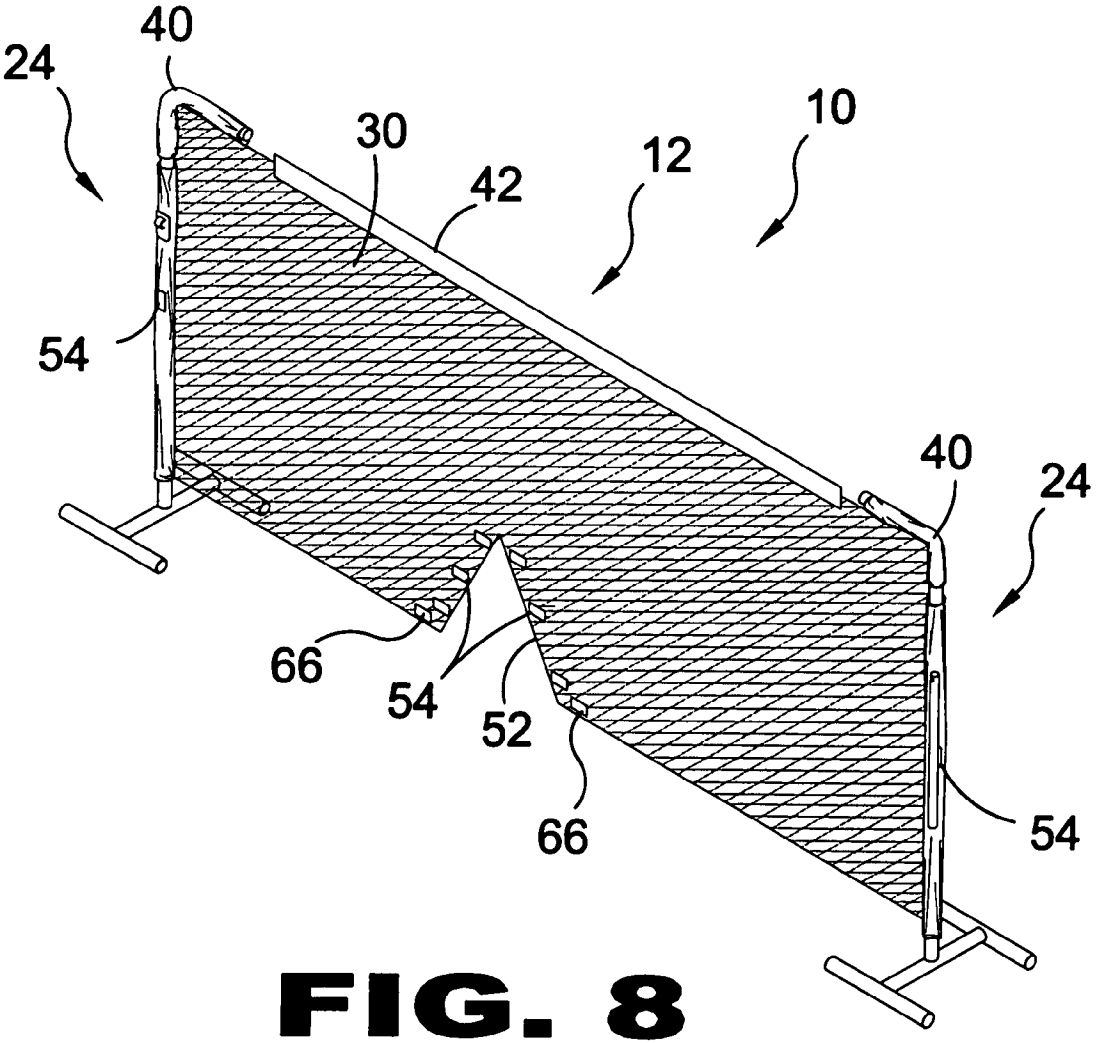
FIG. 8 is a perspective view of the present invention in an open position.

FIG. 8 is a perspective view of the present invention 10 in an open position. Shown is a perspective view of the present invention 10, a portable backstop 12 having spaced apart stanchions 24 with a net 30 disposed therebetween. The stanchions 24 are pulled apart to release the net support plate 42 from the mounting posts 40 The slit 52 in the net 30 is opened by disengaging the mating hook and loop fastening elements 54.

Figure 9:
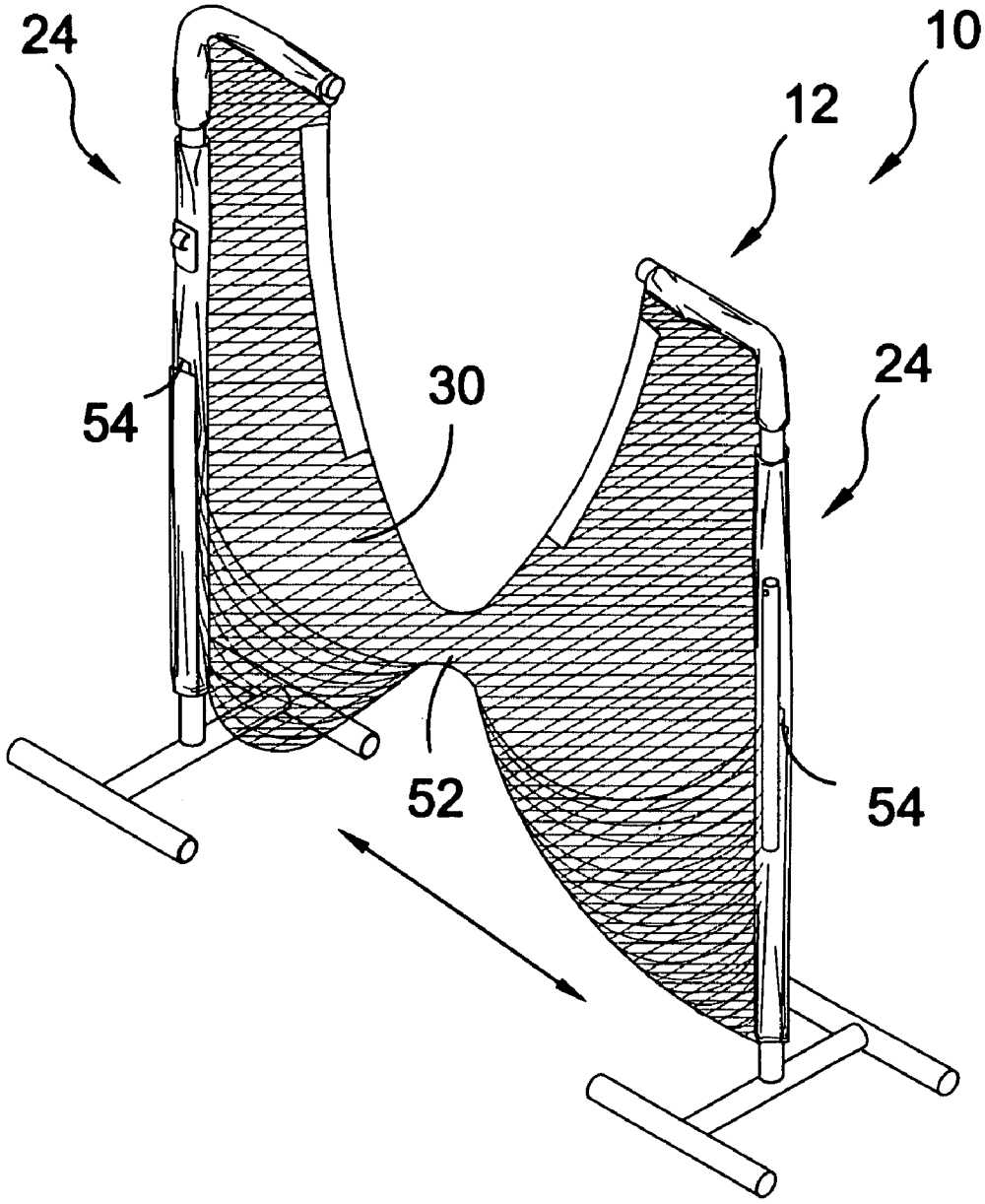
FIG. 9 is a perspective view of the present invention in a partially closed position.

FIG. 9 is a perspective view of the present invention 10 in a partially closed position. The stanchions 24 of the backstop 12 have been drawn toward one another and the corners created by the slit 52 in the net 30 have been fastened to their respective stanchions 24 by means of hook and loop fastener element 54.

Figure 10:
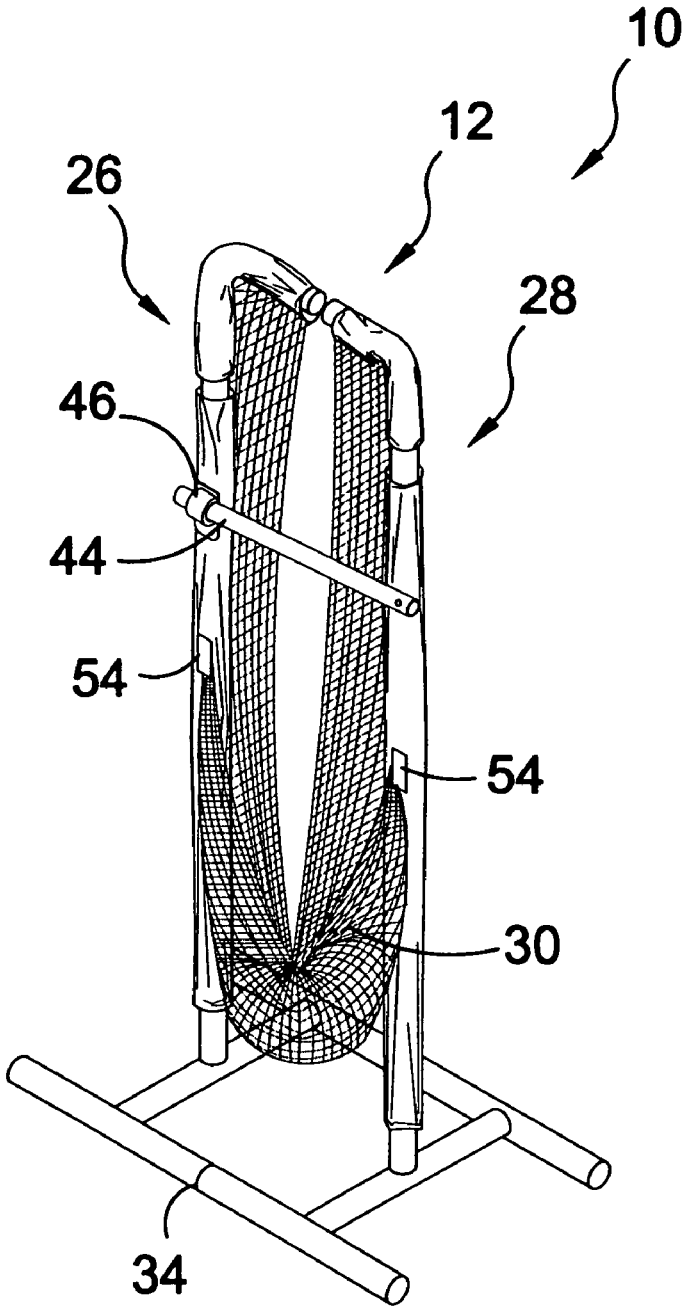
FIG. 10 is a perspective view of the present invention in a fully closed position.

FIG. 10 is a perspective view of the backstop 12 of the present invention 10 in a fully closed position. The connectable feet 34 of the first stanchion 26 have been connected to the feet 34 of the second stanchion 28. The carry rod 44 on the second stanchion 28 has been pivoted and secured with the locking means 46 on the first stanchion 26. The net 30 is secured to the stanchions 26,28 with hook and loop fastening elements 54.

Figure 11:
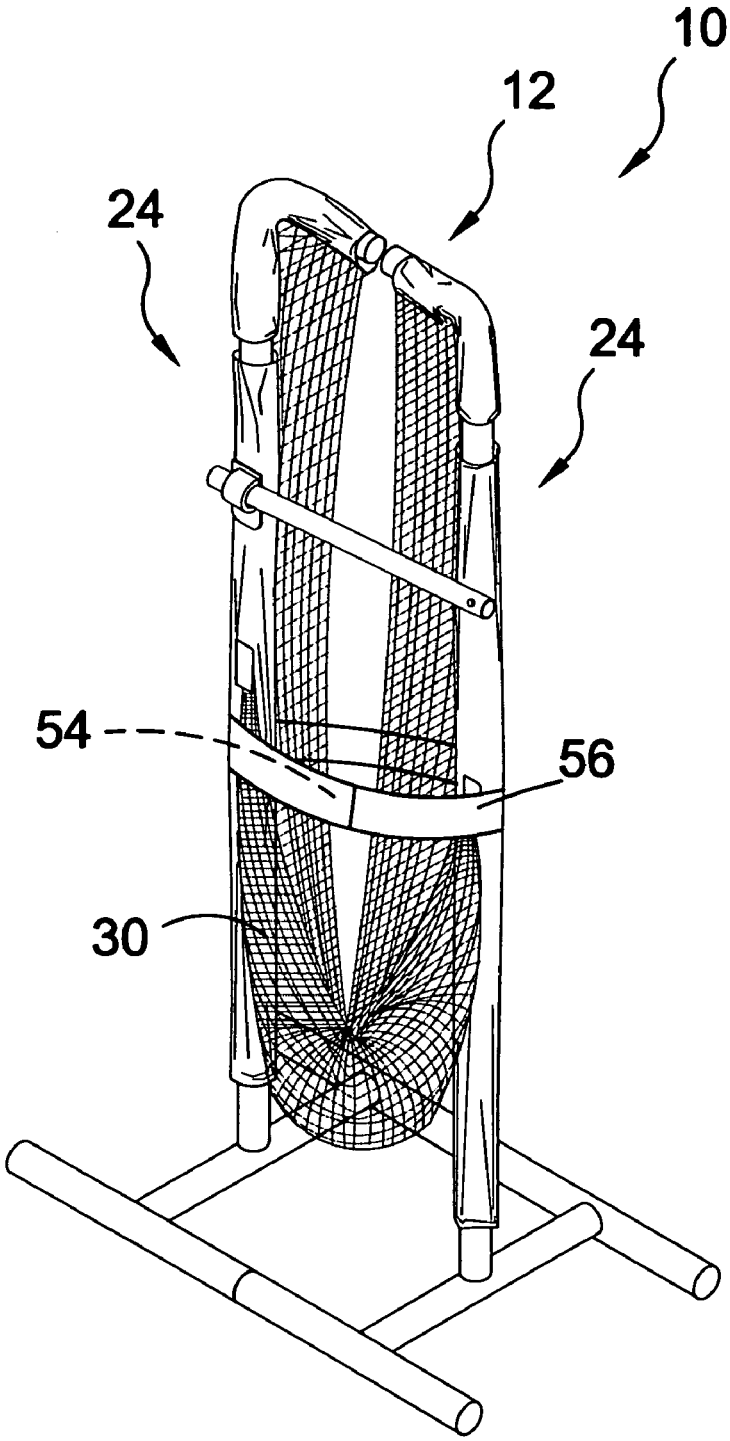
FIG. 11 is a perspective view of the present invention in a fully closed position and having a securing strap.

FIG. 11 is a perspective view of the backstop 12 present invention 10 in a fully closed position and ready for transport and storage. A securing strap 56 has been wrapped around the stanchions 24 and secured with its integral mating hook and loop fastener elements 54 to prevent the bulky portion of the hanging net 30 from swaying freely during transit.

Figure 12:
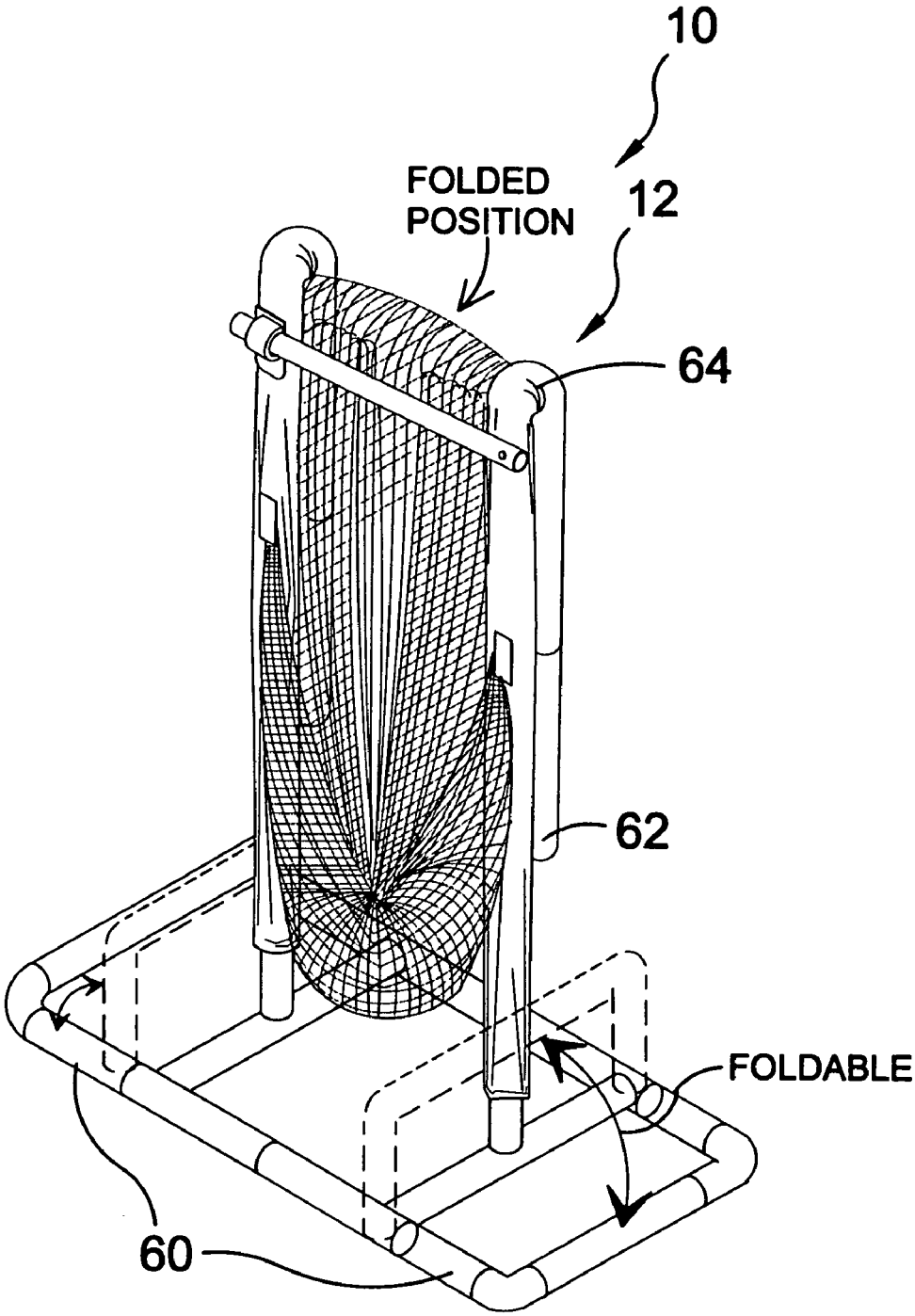
FIG. 12 is a perspective view of an alternate of the present invention in a folded position.

FIG. 12 is a perspective view of an alternate of the present invention 10 in a folded position wherein the backstop 12 can be easily ported and has left and right side foldable feet 60 decreasing the folded footprint size. Hinged 64 foldable posts 62 are also included.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

The invention claimed is:

1. A portable street hockey backstop comprising:

a) a first stanchion and a second opposing stanchion, each said stanchion comprising:

i) a base;

ii) a vertical post extending from said base; and iii) a mounting post extending perpendicularly from the distal end of said vertical post;

b) a net communicating between said first stanchion and said second stanchion;

c) a selectively removable horizontal net support means communicating between said mounting post of said first stanchion and said mounting post of said second stanchion; and d) means for securing said first stanchion to said second stanchion and, wherein said horizontal net support means comprises a rigid support plate disposed on the top edge of said net and being of sufficient length to connect to said mounting post of said first stanchion and to said mounting post of the spaced apart second stanchion when said net is in the fully extended position;

wherein said net support means further includes a pivoting net support strut that is in the horizontal position when not in use and is placed into the vertical position to communicate between said support plate and the upper rear portion of a standard street hockey goal frame during installation to provide stability and central support to said support plate when in use.

2. A portable street hockey backstop as recited in claim 1, wherein each said base comprises a pair of substantially hollow parallel feet having a transverse member communicating between a central portion of each said foot with said vertical post extending from a central portion of said transverse member.

3. A portable street hockey backstop as recited in claim 2, wherein said means of securing said first stanchion to said second section comprises:

a) the interior diameter of said feet of said first stanchion being capable of receiving said feet of said second stanchion;

b) a pivoting carry rod hingedly disposed on said vertical post of said second stanchion being of a length substantially equal to the distance between said vertical posts once said feet are telescoped together;

c) a locking means for securing the distal end of said carry rod to said vertical post of said first stanchion in a substantially perpendicular arrangement; and d) restraining means for securing said net when said first stanchion is interlocked with said second stanchion.

4. A portable street hockey backstop as recited in claim 3, wherein said net restraining means includes at least one hook and loop fastening element affiliated with said vertical post of each said stanchion with mating hook and loop fastening elements disposed on said net thereby enabling the excess net material to be secured thereto.

5. A portable street hockey backstop as recited in claim 4, wherein said net restraining means further includes a centrally disposed slit in a lower portion of said net wherein each side said slit has mating hook and loop fastening elements to seal said slit when in use and to separate said slit and fasten said net to said hook and loop fastener elements disposed on said vertical posts when in the interlocked position.

6. A portable street hockey backstop as recited in claim 4, wherein said net restraining means further includes at least one securing strap having hook and loop fastening elements, said strap being of sufficient length to loop around said vertical posts to prevent the blousy material of said net from excessive movement during transport.

7. A portable street hockey backstop as recited in claim 1, wherein said pivoting net support strut is adapted to be centrally disposed on the street hockey goal frame by a hinged element and the distal end of said net support strut has a groove extending therethrough parallel with said support plate for receiving said plate therein.

8. A portable street hockey backstop as recited in claim 1, that is assembled for use by placing said first stanchion and said second stanchion in spaced apart relation so said net is fully extended and taut, fastening the ends of said net support plate to said mounting posts, pivoting said net support strut and inserting said net support plate therein, thereby effectively forming a backstop frame assembly for connection to the rear of a street hockey goal frame wherein the top and sides of said backstop extend beyond those of the street hockey goal frame thus enabling said backstop to stop any object shot past the street hockey goal frame and proximal thereto.

9. A portable street hockey backstop as recited in claim 1, that is broken down and prepared for transport and storage by removing said net support plate from said net support strut, removing said net support plate from mounting brackets, interlocking foot of said first stanchion with a foot of said second stanchion, releasing hook and loop fastening elements securing a net slit and fastening them to mating hook and loop fastening elements of their respective vertical posts, pivoting a carry rod and securing it with a carry rod locking means, and tightly wrapping a securing strap around said vertical posts and securing it with associated hook and loop fastening elements.

10. A portable street hockey backstop as recited in claim 2, wherein said feet can be folded upward for storage thereby leaving a smaller footprint and having hinged, foldable posts disposed on said distal ends of said vertical posts.

* * * * *